US007594297B2

(12) United States Patent
Choi

(10) Patent No.: US 7,594,297 B2
(45) Date of Patent: Sep. 29, 2009

(54) ANGLE CONTROL APPARATUS FOR UPRIGHT TYPE VACUUM CLEANER

(75) Inventor: Im Suk Choi, Incheon-si (KR)

(73) Assignee: Daewoo Electronics Corporation, Seoul (KR)

( * ) Notice: Subject to any disclaimer, the term of this patent is extended or adjusted under 35 U.S.C. 154(b) by 438 days.

(21) Appl. No.: 11/506,819

(22) Filed: Aug. 18, 2006

(65) Prior Publication Data

US 2007/0039126 A1 Feb. 22, 2007

(30) Foreign Application Priority Data

Aug. 18, 2005 (KR) ..... 10-2005-0075743

(51) Int. Cl.
*A47L 5/30* (2006.01)
*A47L 9/00* (2006.01)

(52) U.S. Cl. ..... 15/328; 15/329; 15/331; 15/334; 15/335; 15/411

(58) Field of Classification Search ..... 15/334, 15/335, 328, 329, 331, 411; *A47L 9/00*
See application file for complete search history.

(56) References Cited

U.S. PATENT DOCUMENTS 5,309,600 A 5/1994 Weaver et al.
5,524,321 A 6/1996 Weaver et al.
5,584,095 A * 12/1996 Redding et al. ..... 15/411
5,715,566 A 2/1998 Weaver et al.
6,006,401 A * 12/1999 Jailor et al. ..... 15/361
6,868,578 B1 3/2005 Kasper et al.
2003/0159411 A1 8/2003 Hansen et al.

* cited by examiner

*Primary Examiner*—David A Redding
(74) *Attorney, Agent, or Firm*—Knobbe Martens Olson & Bear LLP

(57) ABSTRACT

Disclosed herein is an angle control apparatus for an upright type vacuum cleaner. The angle control apparatus comprises a main body having a suction port and a discharge port formed thereon and including a suctioning device inside the suction port, a suction unit having a dust collecting port and a discharge opening and on which the main body is rotatably installed, a suction hose made of an elastic material and positioned between the suction port and the discharge opening, and a locking assembly installed to the suction unit to restrict rotation of the main body. With the angle control apparatus, the main body of the vacuum cleaner is rotatably coupled to the suction unit such that the main body is rotated at a suitable angle with respect to the suction unit sliding on a floor according to a location of a user during the cleaning operation, thereby enabling a convenient cleaning operation.

4 Claims, 6 Drawing Sheets

ANGLE CONTROL APPARATUS FOR UPRIGHT TYPE VACUUM CLEANER

BACKGROUND OF THE INVENTION

1. Field of the Invention

The present invention relates to an upright type vacuum cleaner, and, more particularly, to an angle control apparatus for an upright type vacuum cleaner, by which a main body of the vacuum cleaner is rotatably coupled to a suction unit such that the main body is rotated at a suitable angle with respect to the suction unit sliding on a floor according to a location of a user during a cleaning operation, thereby enabling the cleaning operation to be performed conveniently.

2. Description of the Related Art

A vacuum cleaner is a household appliance which sucks dust and other foreign substances scattered on floors, walls, small gaps and the like in a room via a strong suction force from a negative pressure generated by driving a fan motor and operating a vacuum pump, and then collects the dust and the other foreign substances using a dust collecting filter positioned therein.

According to shapes and using postures, the vacuum cleaners can be classified into a canister type vacuum cleaner, which provides convenience in corner cleaning and movement while allowing easy replacement of a brush and a nozzle, and an upright type vacuum cleaner, which provides convenience in maintenance and allows easy cleaning of a large space.

FIG. 1 is a perspective view illustrating a conventional upright type vacuum cleaner.

The conventional upright type vacuum cleaner comprises a suction unit 100 having wheels 105 attached to a lower surface thereof and serving to suck dust on a floor, a main body 200 having components such as motor and the like contained therein, and an upright type handle 300.

For the upright type vacuum cleaner constructed as above, the suction unit 100 is formed at the lower surface with a suction port (not shown) to which a brush is attached and through which dust removed by the brush is sucked into the suction unit. Then, the sucked dust flows along with air, and is collected via a filter, while the air is discharged to the outside.

The conventional upright type vacuum cleaner has a merit in that, since the suction unit has a wider area than an associated portion of the main body so as to allow the vacuum clean to stand upright thereon, the conventional upright type vacuum cleaner is able to clean a wider area in a room while moving thereon, and can be maintained in an upright state after finishing the cleaning operation.

However, for the conventional upright type vacuum cleaner, since the main body is integrally formed with the suction unit, the main body is maintained in the upright state even when the user pushes the main body and the suction unit away from the user, so that an angle between the handle and the hand of the user is increased, causing inconvenience of the user. Accordingly, there is a need of an improved vacuum cleaner which overcomes this problem.

SUMMARY OF THE INVENTION

The present invention has been made in view of the above problems of the conventional vacuum cleaner, and it is an object of the present invention to provide an angle control apparatus of a vacuum cleaner, by which a main body is rotatably coupled to a suction unit such that the main body is rotated at a suitable angle according to a distance between a user and the main body when the user pushes or pulls the main body during a cleaning operation, thereby enabling an angle between an arm of the user and a handle to be maintained within a predetermined range.

According to an aspect of the present invention, the above and other objects can be accomplished by the provision of an angle control apparatus for an upright type vacuum cleaner, comprising: a main body having a suction port and a discharge port formed thereon, and including a suctioning device inside the suction port; a suction unit having a dust collecting port and a discharge opening, and on which the main body is rotatably installed; a suction hose made of an elastic material and positioned between the suction port and the discharge opening; and a locking assembly installed to the suction unit to restrict rotation of the main body.

Preferably, the angle control apparatus further comprises a connection panel rotatably coupled at one end to an upper surface of the suction unit, and having an upper surface on which the main body is installed.

Preferably, the connection panel comprises an upper panel on which the main body is installed, a lower panel coupled to a bottom surface of the upper panel and provided with wheels such that the wheels protrude below a bottom surface of the suction unit, and a securing panel fastened to the suction unit while rotatably restricting a rotational shaft of the wheels. Preferably, the upper panel is formed with a connecting hole at one side thereof corresponding to the discharge opening, the connecting hole having an upper end into which the suction hose is inserted, and a lower end into which a connection pipe extending from the discharge opening is inserted.

Preferably, the locking assembly comprises a lever rotatably installed within the connection panel and having one end protruding outside the connection panel, a latch part depressed into a bottom surface at the other end of the lever, a protrusion formed corresponding to the latch part on the upper surface of the suction unit so as to be inserted into the connection panel, and a coil spring inserted to a rotational shaft of the lever to maintain a latched state of the protrusion by the latch part.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Preferred embodiments of the present invention will be described in detail with reference to the accompanying drawings as follows.

Figure 1:
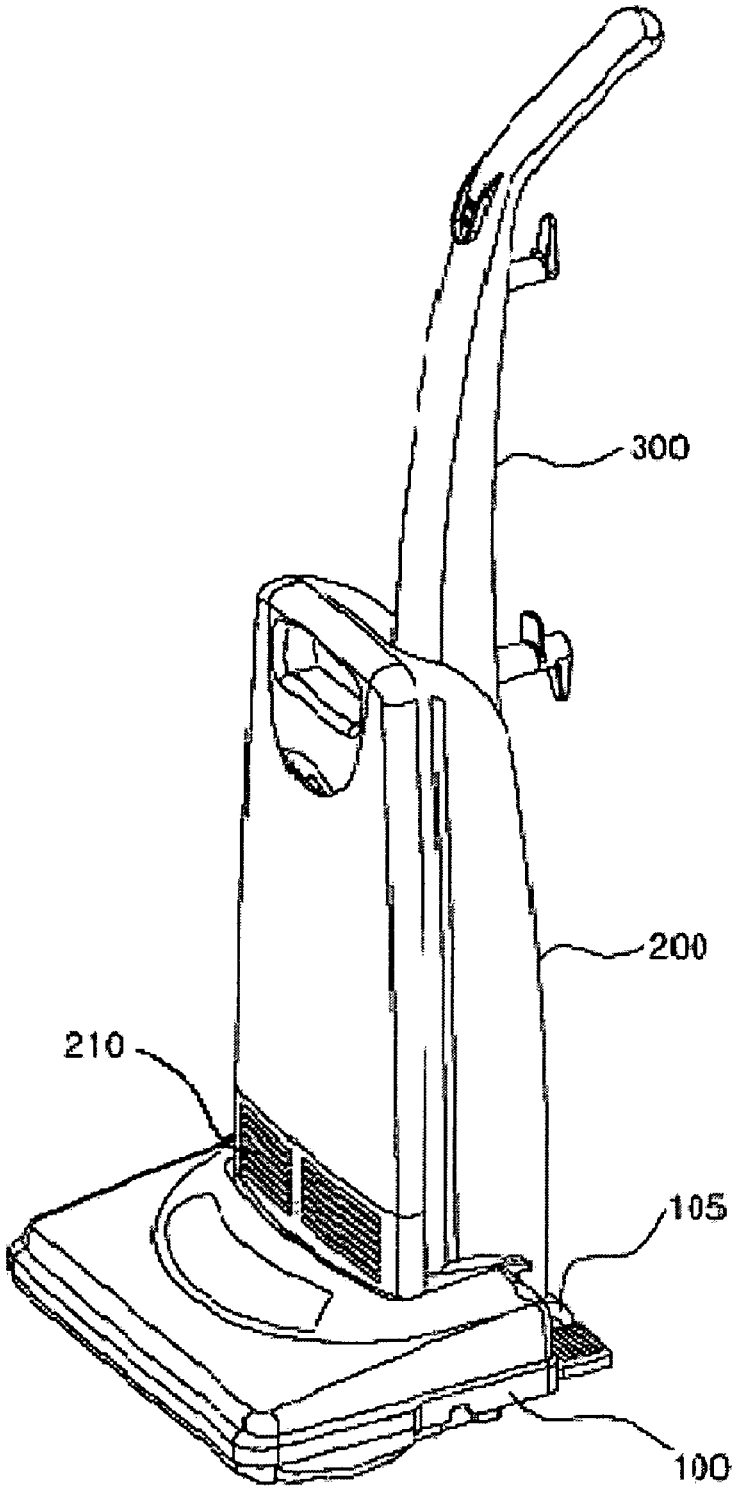
FIG. 1 (Prior Art)
FIG. 1 is a perspective view illustrating a conventional upright type vacuum cleaner.
Figure 2:
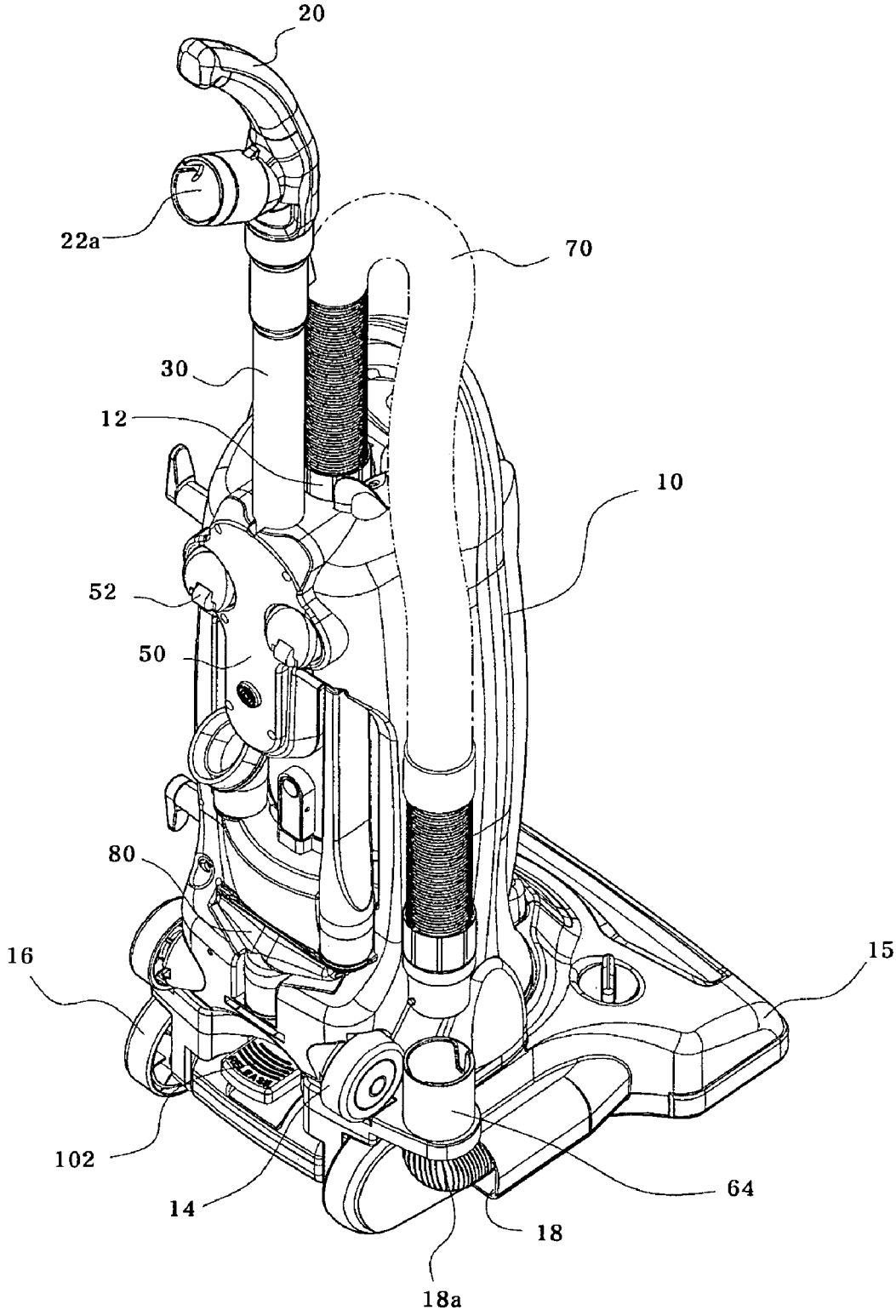
FIG. 2 is a rear perspective view illustrating an upright type vacuum cleaner according to the present invention.
Figure 3:
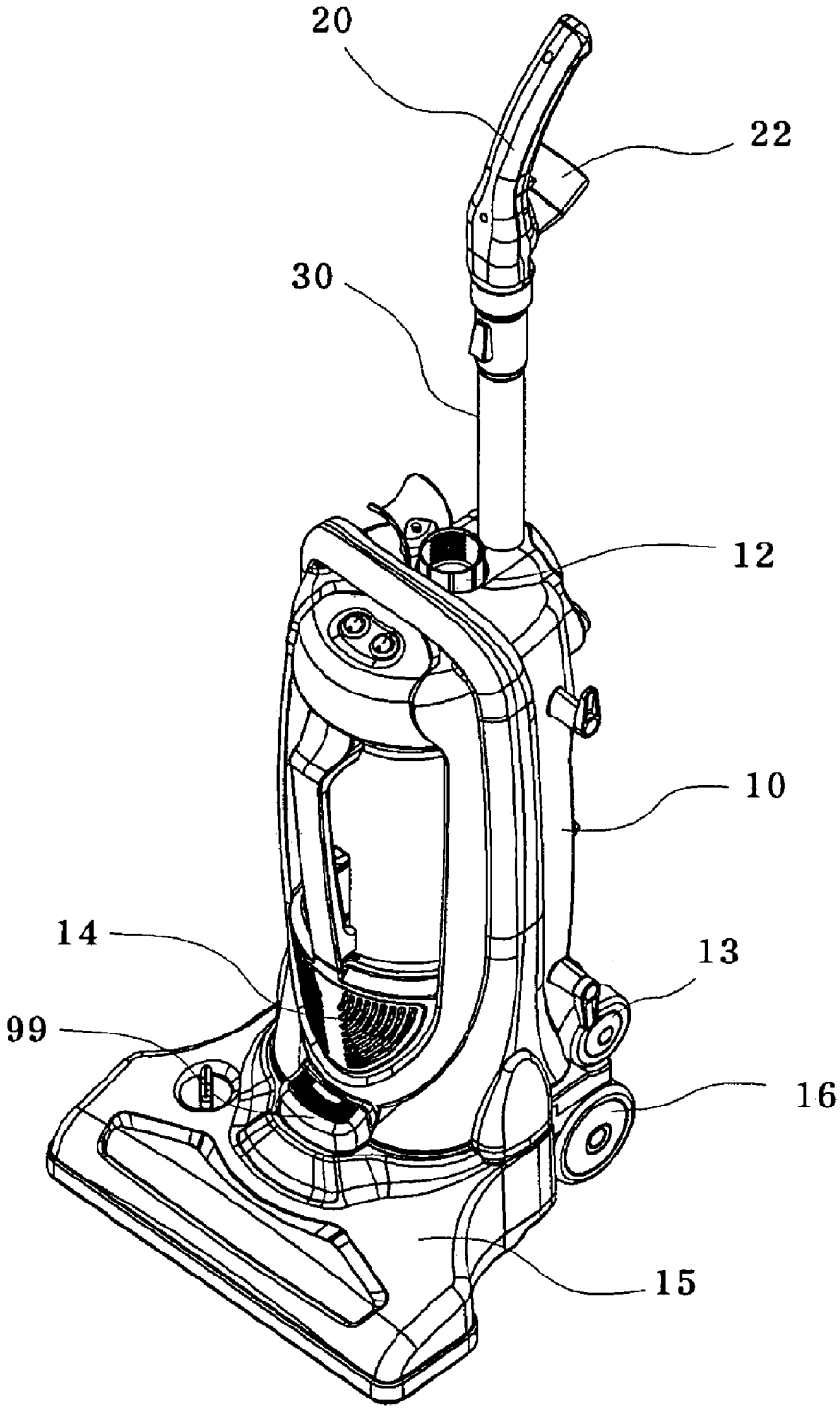
FIG. 3 is a front perspective view illustrating the upright type vacuum cleaner according to the present invention.

FIG. 2 is a rear perspective view illustrating an upright type vacuum cleaner according to the present invention, and FIG. 3 is a front perspective view illustrating the upright type vacuum cleaner according to the present invention.

The upright type vacuum cleaner according to the present invention comprises: a main body 10 having a suction port 12 and a discharge port 14 formed thereon, and being installed with a suction fan (not shown) inside the suction port 12; a suction unit 15 having a dust collection port (not shown) and a discharge opening 18, and on which the main body 10 is rotatably mounted; a connection panel 60 rotatably coupled at one end thereof to an upper surface of the suction unit 15 and having an upper surface on which the main body 10 is installed; a suction hose 70 made of an elastic material and positioned between the suction port 12 and the discharge opening 18; and a locking assembly 100 installed to the suction unit 15 to restrict rotation of the main body 10.

Figure 4:
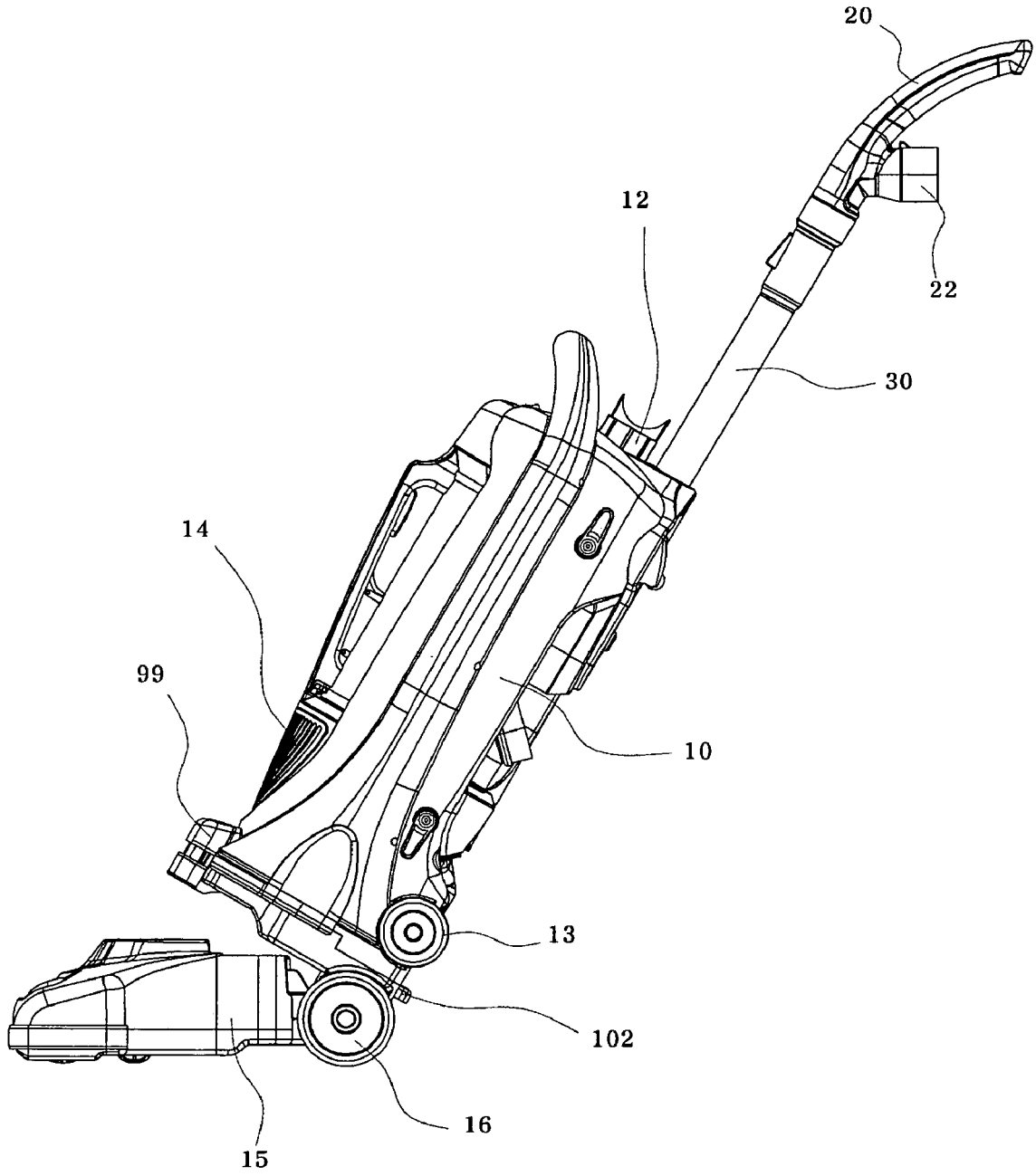
FIG. 4 is a side elevation illustrating a using state of the upright type vacuum cleaner according to the present invention.

With this structure, when rotating the connection panel 60 with respect to the suction unit 15 via the locking assembly 100, the main body 10 of the vacuum cleaner mounted on an upper surface of the connection panel 60 is able to rotate with respect to the suction unit 15 so that an installation angle of the main body 10 can be adjusted as shown in FIG. 4.

Figure 5:
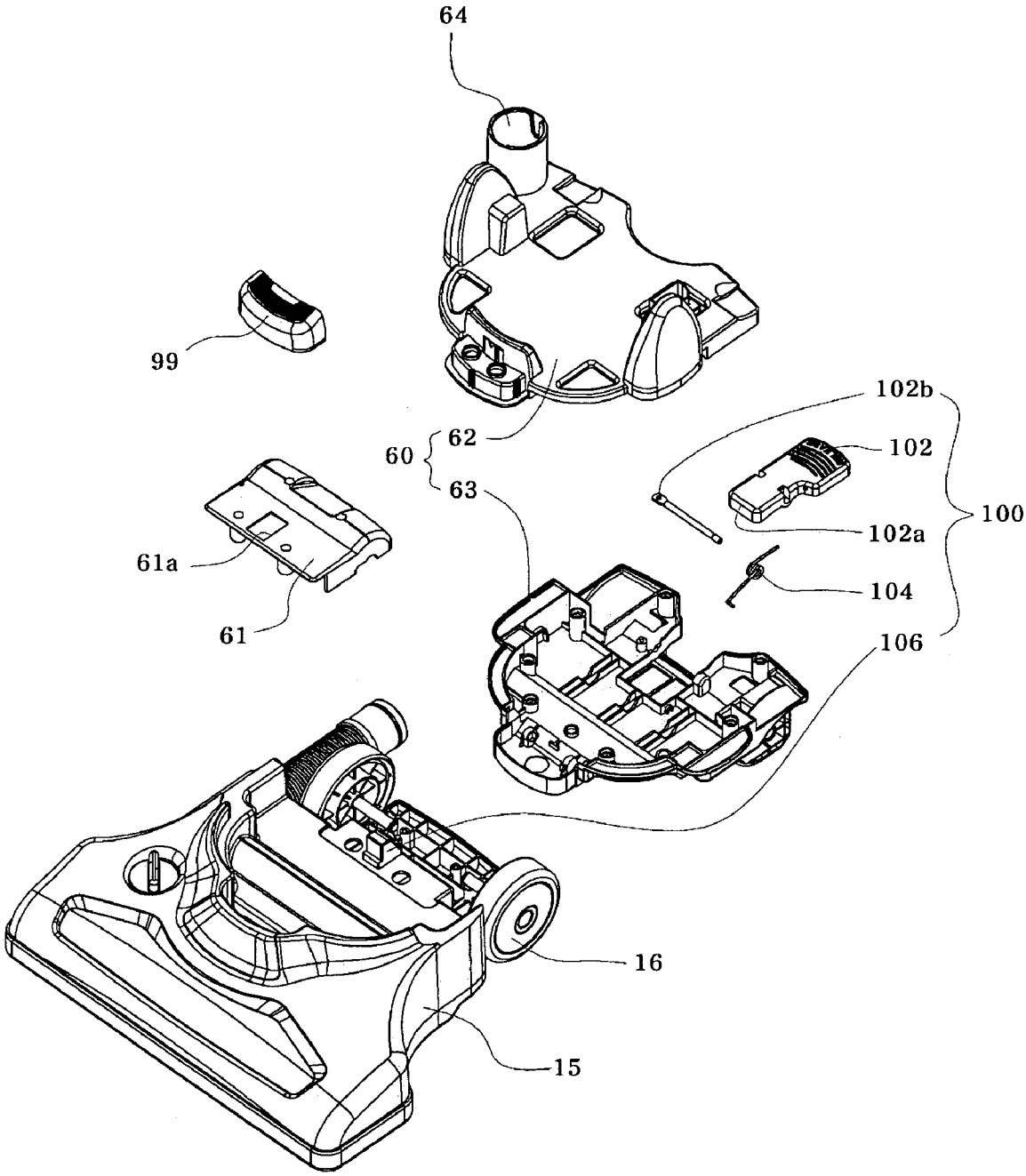
FIG. 5 is an exploded perspective view illustrating a connection panel and a locking assembly of the present invention.
Figure 6:
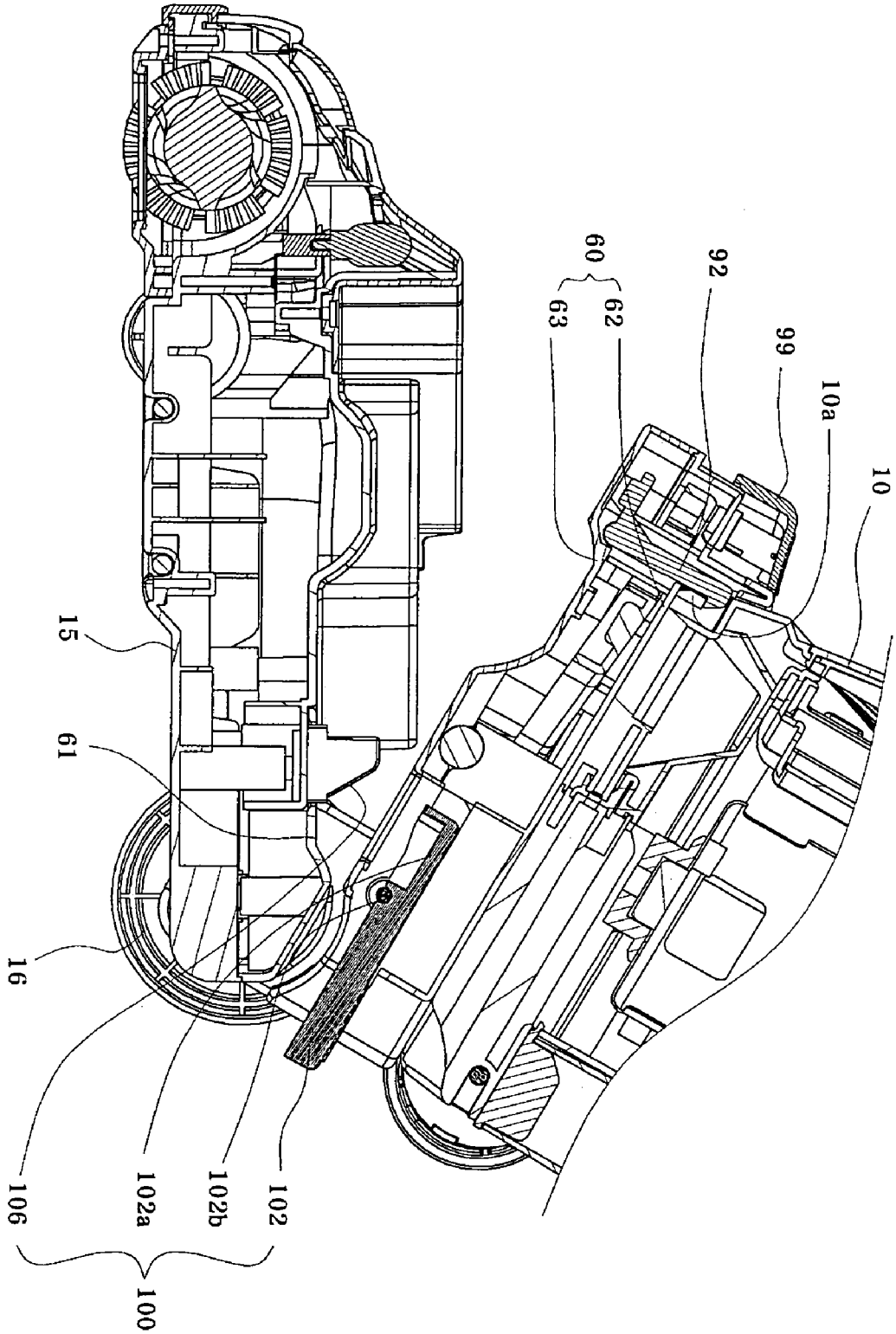
FIG. 6 is a cross-sectional view illustrating the connection panel and the locking assembly of the present invention.

FIG. 5 is an exploded perspective view illustrating the connection panel and the locking assembly of the present invention, and FIG. 6 is a cross-sectional view illustrating the connection panel and the locking assembly of the present invention.

The connection panel 60 comprises an upper panel 62 on which the main body 10 is installed, a lower panel 63 coupled to a bottom surface of the upper panel 60 and provided with a pair of wheels 16 installed at both ends of a rear side of the lower panel 63 such that the wheels 16 protrude under a bottom surface of the suction unit 15, and a securing panel 61 fastened to the suction unit 15 while rotatably restricting a rotational shaft 16 of the wheels. After the locking assembly denoted by reference numeral 100 is disposed between the upper and lower panels 62 and 63, and coupled to the suction unit 15, the rotational shaft of the wheels 16 is seated in a groove formed in rear of the suction unit 15, and the securing panel 61 is coupled to an upper surface of the groove by means of bolts and nuts so that the rotational shaft of the wheels 16, fitted thereto from both ends of the lower panel 63 to the center thereof, is rotatably installed to the groove of the suction unit 15. As a result, the connection panel 60 is rotatably connected with the suction unit 15.

The upper panel 62 has a connecting hole 64 formed at one side thereof corresponding to the discharge opening 18. The connecting hole 64 has a lower end into which a connection pipe 18*a* extending from the discharge opening 18 is inserted, and an upper end into which the suction hose 70 is inserted. Meanwhile, when the locking assembly 100 is released and then the connection panel 60 is rotated, the distance between the discharge opening 18 and the connecting hole 64 is changed. In this regard, since the connection pipe 18*a* is a corrugated pipe formed of the same soft material as that of the suction hose 70, the connection pipe 18*a* can be extended or shortened when inducing foreign substances and air therethrough.

The locking assembly 100 comprises a lever 102 rotatably installed within the connection panel 60 and having one end protruding outside the connection panel 60, a latch part 102*a* depressed into a bottom surface at the other end of the lever 102, a protrusion 106 formed corresponding to the latch part 102*a* on the upper surface of the suction unit 15 so as to be inserted into the connection panel 60, and a coil spring 104 inserted to a rotational shaft 102*b* of the lever 102 to maintain a latched state of the protrusion 106 by the latch part 102*a*. When the locking assembly 100 is coupled to the suction unit 15 by the securing panel 61 with the lever 102, the rotational shaft 102*b* and the coil spring 104 disposed and assembled with each other between the upper panel 62 and the lower panel 63, resilient force is generated, which causes the lever 102 to be rotated about the rotational shaft 102*b* in the counterclockwise direction on the paper of FIG. 6 by the coil spring 104. Thus, when the connection panel 60 is seated on the upper surface of the suction unit 15, the protrusion 106 is inserted into the connection panel 60 through a hole formed in the lower panel 63, and latched to the latch part 102*a* of the lever 102, thereby restricting rotation of the connection panel 60.

Operation of the angle control apparatus for the upright type vacuum cleaner according to the present invention will be described hereinafter.

First, when a user steps on the lever 102 protruding outward of the connection panel 60, the coil spring 104 is compressed, and at the same time, the lever 102 and the latch part 102*a* are rotated in the clockwise direction from a state shown in FIG. 6. When the connection panel 60 is released from the protrusion 106, rotation of the connection panel 60 is permitted. Thus, the main body 10 and the connection panel 60 can rotate about the rotational shaft of the wheels 16 in the clockwise direction.

With the main body 10 and the connection panel 60 displaced to rotate as above, when the user pushes the vacuum cleaner with the handle 20 in a front direction as shown in FIG. 4, the main body 10 and the connection panel 60 are rotated in the clockwise direction while the suction unit 15 is sliding on a floor so that an angle defined between an arm of the user and the handle 20 is maintained at a predetermined angle or less.

With the structure and operation as described above, the angle control apparatus for the upright type vacuum cleaner enables a convenient cleaning operation to the user when pushing or pulling the vacuum cleaner.

According to the present invention, since the main body independent of the suction unit is rotatably coupled to the suction unit via the angle control apparatus of the vacuum cleaner such that the main body is slanted to a user's side during a cleaning operation, the main body of the vacuum cleaner is slanted at a suitable angle according to a distance between the vacuum cleaner and the user when the user pushes or pulls the vacuum cleaner, so that an angle between an arm of the user and a handle is maintained within a predetermined range, thereby enabling a convenient cleaning operation.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An angle control apparatus for an upright type vacuum cleaner, comprising:

a main body having a suction port and a discharge port formed thereon, and including a suction device inside the suction port;

a suction unit having a dust collecting port and a discharge opening, and on which the main body is rotatably installed;

a suction hose made of an elastic material and positioned between the suction port and the discharge opening;

a locking assembly installed to the suction unit to restrict rotation of the main body; and a connection panel rotatably coupled at one end to an upper surface of the suction unit, and having an upper surface on which the main body is installed, wherein the connection panel comprises an upper panel on which the main body is installed, a lower panel coupled to a bottom surface of the upper panel and provided with wheels such that the wheels protrude below a bottom surface of the suction unit, and a securing panel fastened to the suction unit while rotatably restricting a rotational shaft of the wheels.

2. The angle control apparatus according to claim 1, wherein the upper panel is formed with a connecting hole at one side thereof corresponding to the discharge opening, the connecting hole having an upper end into which the suction hose is inserted, and a lower end into which a connection pipe extending from the discharge opening is inserted.

3. An angle control apparatus for an upright type vacuum cleaner, comprising:

a main body having a suction port and a discharge port formed thereon, and including a suction device inside the suction port;

a suction unit having a dust collecting port and a discharge opening, and on which the main body is rotatably installed;

a suction hose made of an elastic material and positioned between the suction port and the discharge opening;

a locking assembly installed to the suction unit to restrict rotation of the main body; and a connection panel rotatably coupled at one end to an upper surface of the suction unit, and having an upper surface on which the main body is installed, wherein the locking assembly comprises a lever rotatably installed within the connection panel and having one end protruding outside the connection panel, a latch part depressed into a bottom surface at the other end of the lever, a protrusion formed corresponding to the latch part on the upper surface of the suction unit so as to be inserted into the connection panel, and a coil spring inserted to a rotational shaft of the lever to maintain a latched state of the protrusion by the latch part.

4. The angle control apparatus according to claim 1, wherein the locking assembly comprises a lever rotatably installed within the connection panel and having one end protruding outside the connection panel, a latch part depressed into a bottom surface at the other end of the lever, a protrusion formed corresponding to the latch part on the upper surface of the suction unit so as to be inserted into the connection panel, and a coil spring inserted to a rotational shaft of the lever to maintain a latched state of the protrusion by the latch part.

* * * * *

UNITED STATES PATENT AND TRADEMARK OFFICE

CERTIFICATE OF CORRECTION

PATENT NO. : 7,594,297 B2
APPLICATION NO. : 11/506819
DATED : September 29, 2009
INVENTOR(S) : Im Suk Choi It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 480 days.

Signed and Sealed this

Twenty-eighth Day of September, 2010

David J. Kappos

David J. Kappos
*Director of the United States Patent and Trademark Office*